US007562466B2

(12) United States Patent
Santhouse

(10) Patent No.: US 7,562,466 B2
(45) Date of Patent: Jul. 21, 2009

(54) ION GENERATING DEVICE

(75) Inventor: Daniel Santhouse, Wilton, CT (US)

(73) Assignee: Conair Corporation, Stamford, CT (US)

( * ) Notice: Subject to any disclaimer, the term of this patent is extended or adjusted under 35 U.S.C. 154(b) by 198 days.

(21) Appl. No.: 10/510,431

(22) PCT Filed: May 29, 2003

(86) PCT No.: PCT/US03/17127

§ 371 (c)(1),
(2), (4) Date: Jul. 7, 2005

(87) PCT Pub. No.: WO03/101242

PCT Pub. Date: Dec. 11, 2003

(65) Prior Publication Data

US 2007/0085036 A1 Apr. 19, 2007

Related U.S. Application Data

(60) Provisional application No. 60/383,981, filed on May 29, 2002.

(51) Int. Cl.
*F26B 3/34* (2006.01)

(52) U.S. Cl. ..... 34/253; 34/283; 34/97

(58) Field of Classification Search ..... 34/247, 34/253, 254, 283, 96, 97, 98, 99, 100, 101; 361/212, 213; 392/380, 385
See application file for complete search history.

(56) References Cited

U.S. PATENT DOCUMENTS

| | | | | | |
|---|---|---|---|---|---|
| 3,892,247 | A * | 7/1975 | Andersen | 132/148 |
| 3,997,817 | A * | 12/1976 | Secker | 361/213 |
| 4,039,774 | A * | 8/1977 | Kata et al. | 392/384 |
| 4,258,408 | A * | 3/1981 | Cantelli | 361/213 |
| 4,500,939 | A * | 2/1985 | Gueret | 361/221 |
| 4,797,966 | A * | 1/1989 | Fong | 15/186 |
| 5,055,963 | A * | 10/1991 | Partridge | 361/231 |
| 5,150,491 | A * | 9/1992 | Ikemoto | 15/1.52 |
| 5,388,769 | A * | 2/1995 | Rodrigo et al. | 239/690 |
| 5,612,849 | A * | 3/1997 | Prehodka et al. | 361/213 |
| 5,805,406 | A * | 9/1998 | Mailand | 361/212 |
| 5,941,253 | A * | 8/1999 | Kaizuka | 135/232 |
| 5,957,090 | A * | 9/1999 | Larson | 119/600 |
| 6,182,671 | B1 | 2/2001 | Taylor et al. | |
| 6,191,930 | B1 * | 2/2001 | Ramchandani | 361/213 |
| 6,199,295 | B1 | 3/2001 | Smal et al. | |
| 6,393,718 | B1 | 5/2002 | Harris et al. | |
| 6,640,049 | B1 | 10/2003 | Lee et al. | |

* cited by examiner

*Primary Examiner*—Kenneth B Rinehart
(74) *Attorney, Agent, or Firm*—Lawrence Cruz

(57) ABSTRACT

There is provided a device for hair care having a housing with at least one aperture, one or more ion generators for selectively generating concentrations of ions having different combinations of intensity and polarity, and one or more ion emitters for selectively emitting concentrations of ions having different combinations of intensity and polarity. The device can be any device or combination of such devices, suitable for use with hair and for to optimize the known beneficial effects of ionization to hair of the user.

19 Claims, 12 Drawing Sheets

ION GENERATING DEVICE

CROSS REFERENCE TO RELATED PATENT APPLICATIONS

This patent application claims priority to International Patent Application Ser. No. PCT/US03/17127 filed on 29 May 2003, and claims priority to U.S. Provisional Patent Application Ser. No.: 60/383,981 filed on 29 May 2002.

BACKGROUND OF THE INVENTION

1. Field of the Invention

The present invention relates to a device for generating ions. More particularly, the present invention relates to a device for treating and/or styling hair, as well as for generating a concentration of ionized air.

2. Description of the Prior Art

Benefits associated with air ionization are well known. It is also known to provide different devices with ways for generating and emitting ions. See for example, U.S. Pat. Nos. 6,182,671, 5,957,090, 5,941,253, 5,150,491, 4,797,966, 4,500,939, 3,997,817, and 3,892,247. Further, it is known to provide different ion emitting devices with a blower for generating an airflow for directing the emitted ions. See for example U.S. Pat. Nos. 6,191,930, 5,805,406, 5,612,849, 5,388,769, 5,055,963, and 4,258,408.

None of the above provide for a device that is capable of adjustably producing ions having different polarities, adjustably controlling the level of ion concentration, and adjustably manipulating the distribution and mix of ions with hair in combination with the feature that the ions are created outside a housing and at a distance from the head and/or hair of a user.

SUMMARY OF THE INVENTION

It is an object of the present invention to provide a device with an improved ionic aeration effect.

It is another object of the present invention to provide such a device that can produce ions having different polarities and control the level of ion concentration.

It is still another object of the present invention to provide such a device that creates a concentration of ions beyond a casing or housing, to maximize the concentration of ions about the head and/or hair of a user, as well as allow for the safe and efficient maintenance or replacement of at least one ion emitter.

It is yet another object of the present invention to provide such a device with an adjustable airflow controller.

It is further another object of the present invention to provide a number of attachments for cooperation with the device to control the distribution of the airflow as well as the mixing of ions with the airflow.

These and other objects and advantages of the present invention are achieved by a device that provides for an improved ion aeration effect. The device has a housing, at least one ion generator for generating, simultaneously or alternatively, ions with different polarities, and at least one ion emitter located outside the housing for emitting, simultaneously or alternatively, ions with different polarities. In addition, the device can have a blower for generating an airflow at a distance from the at least one ion emitter. Still further, the device can cooperate with a number of different attachments to manipulate the ionic aeration or the distribution and mix of ions with the air and hair of a user.

DETAILED DESCRIPTION OF THE INVENTION

Figure 2:
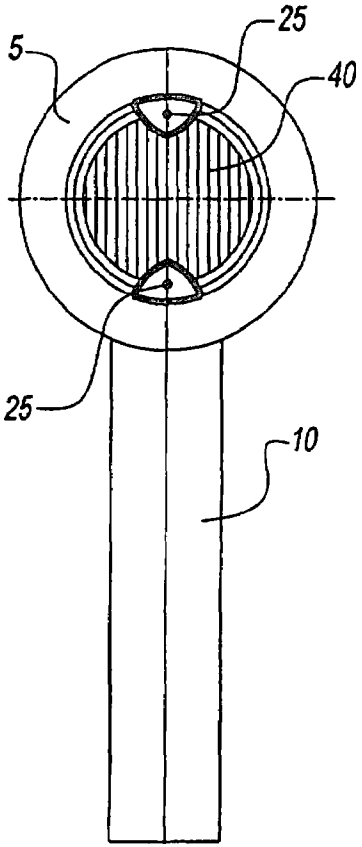
FIG. 2 is an end view of the device of FIG. 1.
Figure 1:
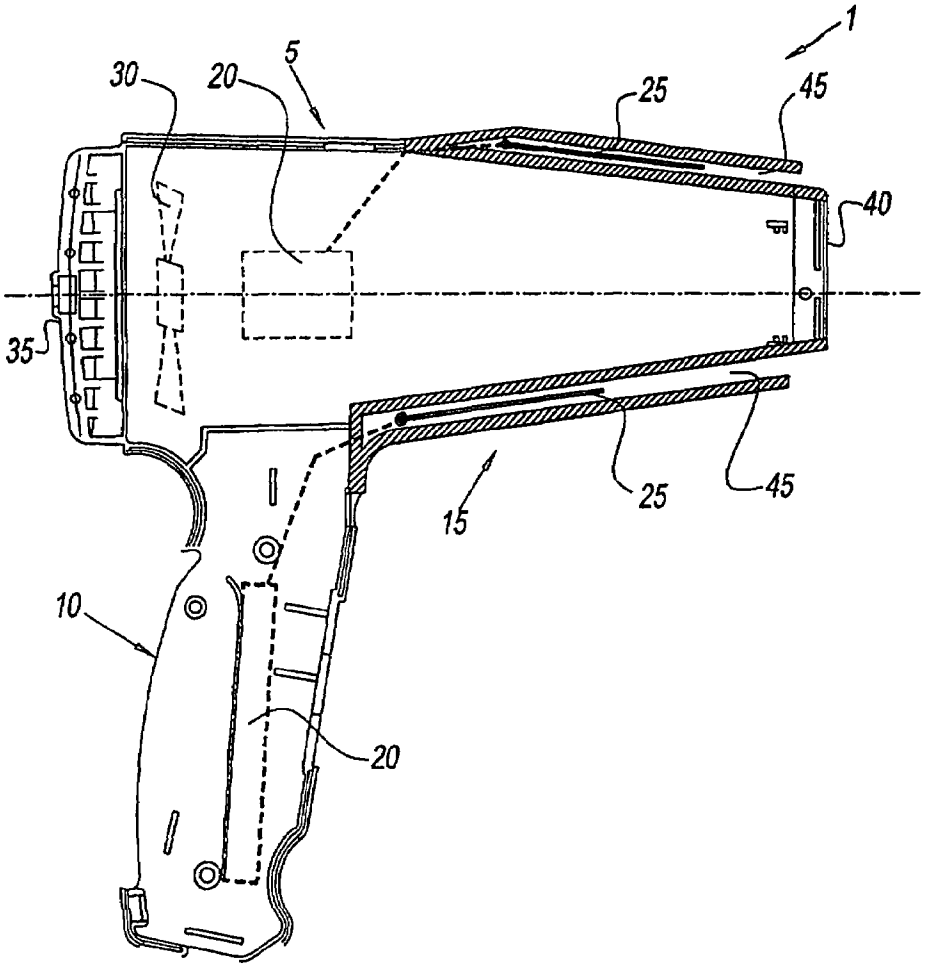
FIG. 1 is a lateral sectional view of a device, in accordance with a preferred embodiment of the present invention.

Referring to the drawings and more particularly to FIGS. 1 and 2, there is shown a device in accordance with a preferred embodiment of the present invention generally represented by reference numeral 1. Device 1, as shown, preferably takes the form of a conventional hand held hair dryer having a housing 5 with a lower handle portion 10 and an upper barrel portion 15. Preferably device 1 also has one or more ion generators 20 for generating ions of positive polarity and ions of negative polarity, and one or more ion emitters 25 situated outside housing 5 for emitting ions of positive polarity and ions of negative polarity.

Preferably, housing 5 has a blower 30, an inlet 35, and an air outlet. Blower 30 is a conventional type blower that is sufficient for generating airflow. Preferably, blower 30 draws air into housing 5 through air inlet 35, through the upper barrel portion 15 of housing 5, and out air outlet 40. Preferably, the air exiting air outlet 40 can be directed toward the hair of a user for drying and/or styling.

In addition, housing 5, preferably has a control (not shown) operatively connected to blower 30 for altering the intensity of the airflow, and thereby affecting the overall concentration of ions within the airflow. Preferably, the control can also be operatively connected to a heater (not shown), and/or the one or more ion generators 20, and/or the one or more ion emitters 25 for controlling the operation of each component.

As shown in FIGS. 1 and 2, housing 5 can also have any configuration and/or feature known to be associated with conventional hair dryers. For example, FIGS. 3 through 12 show various attachments that can selectively cooperate with housing 5 to manipulate the airflow exiting air outlet 40. Accordingly, the distribution and intensity of the airflow, as well as the aeration of ions with the airflow, is controlled.

Preferably, one or more ion generators 20 is situated in the lower handle portion 10 of housing 5. However, one or more ion generators 20 may also be located in the upper barrel portion 15 of housing 5. Further, one or more ion generators 20 may be located in both the lower handle portion 10 and upper barrel portion 15 simultaneously, as shown in FIG. 1. Still further, one or more ion generators 20 can be positioned at any location suitable to optimize the effective operation of device 1.

In addition, one or more ion generators 20, preferably can be any suitable device capable of adjustably generating voltage outputs of varying intensities and of varying polarity combinations. Also, one or more ion generators 20 is/are electronically connected to one or more ion emitters 25. Further, one or more ion generators 20 and one or more ion emitters 25 are configured for safety, as well as for protection from damage caused by extensive use.

Figure 1A:
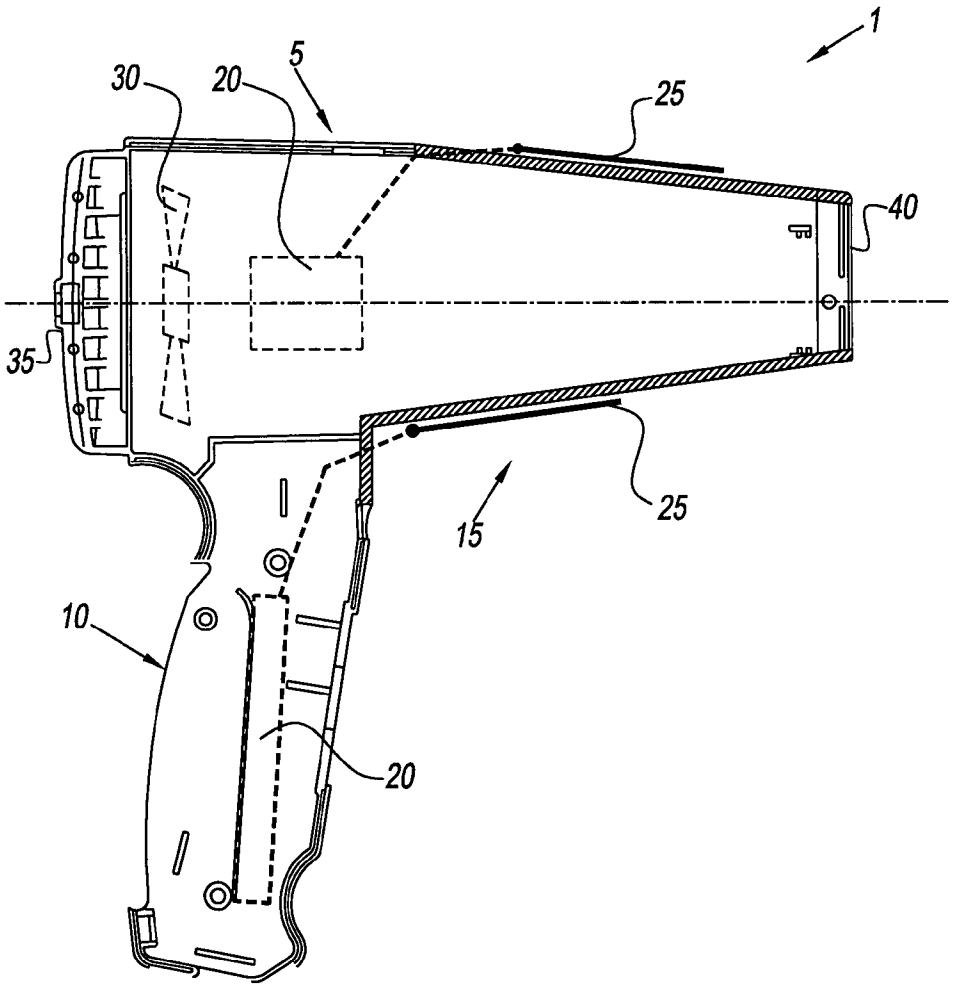
FIG. 1A is a lateral section view of the embodiment of the device in which the casing is selectively removable.
Figure 4:
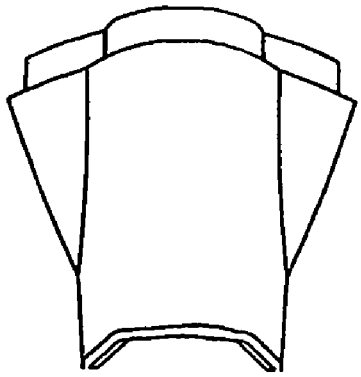
FIG. 4 is a lateral view of the first attachment of FIG. 3.
Figure 3:
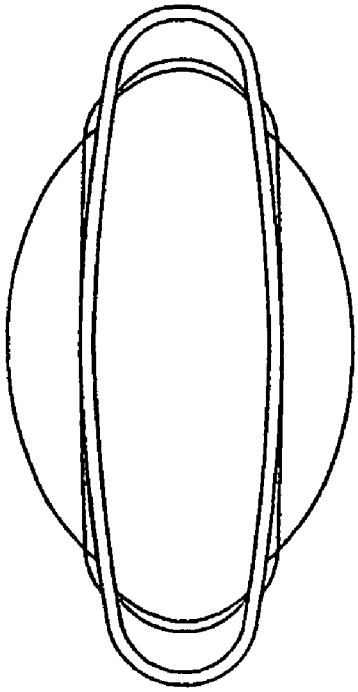
FIG. 3 is an end view of a first attachment for cooperation with the device of FIG. 1, in accordance with an alternative embodiment of the present invention.
Figure 6:
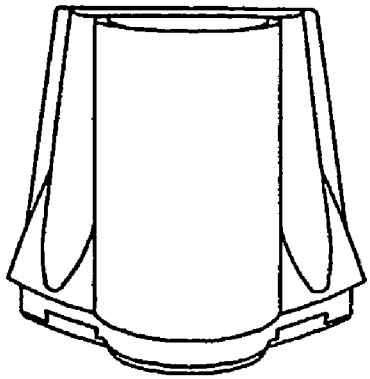
FIG. 6 is a lateral view of the second attachment of FIG. 5.
Figure 5:
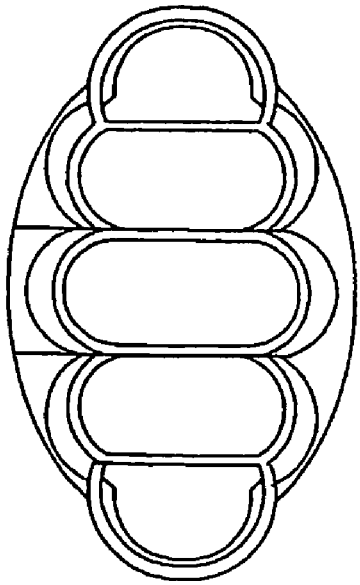
FIG. 5 is an end view of a second attachment for cooperation with the device of FIG. 1, in accordance with an alternative embodiment of the present invention.
Figure 8:
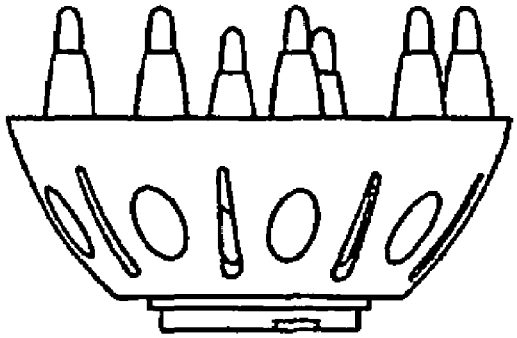
FIG. 8 is a lateral view of the third attachment of FIG. 7.
Figure 7:
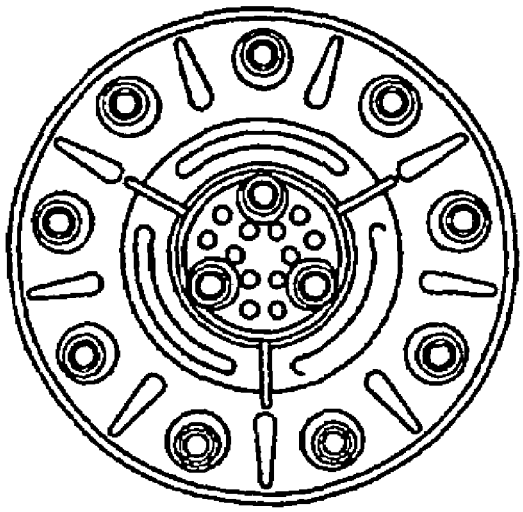
FIG. 7 is an end view of a third attachment for cooperation with the device of FIG. 1, in accordance with an alternative embodiment of the present invention.
Figure 10:
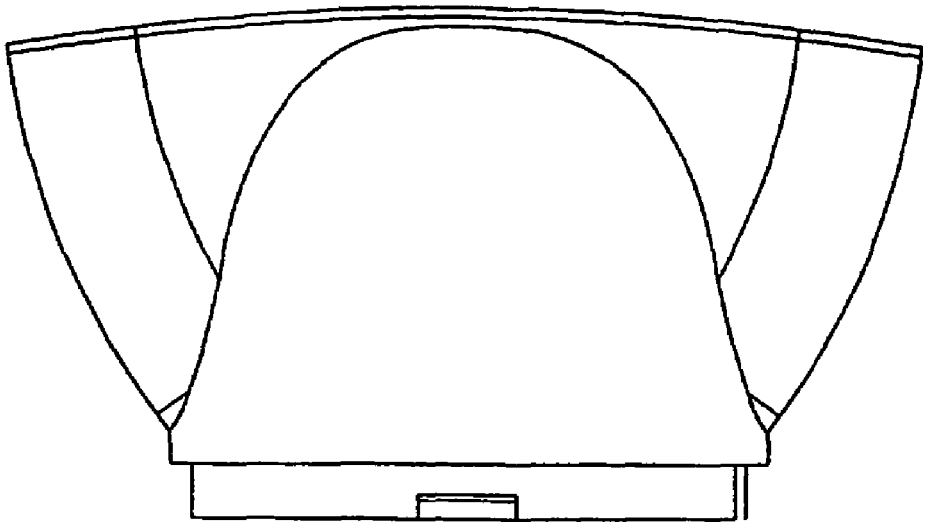
FIG. 10 is a lateral view of the fourth attachment of FIG. 9.
Figure 9:
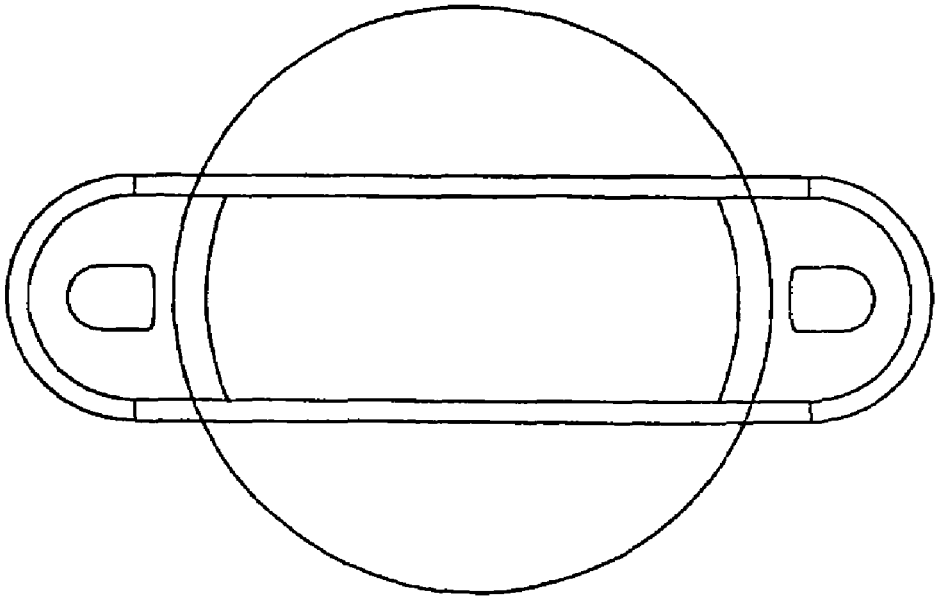
FIG. 9 is an end view of a fourth attachment for cooperation with the device of FIG. 1, in accordance with an alternative embodiment of the present invention.
Figure 12:
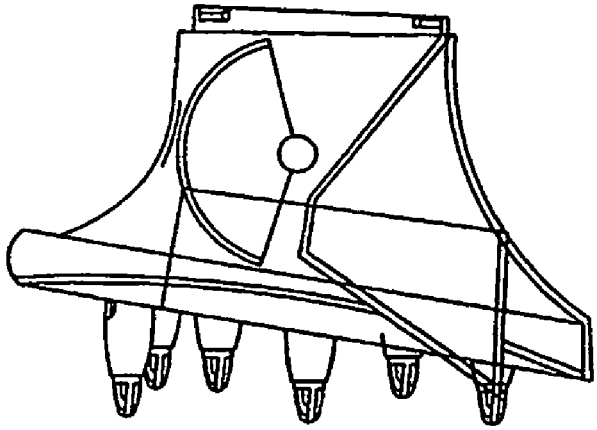
FIG. 12 is a lateral view of the fifth attachment of FIG. 11.
Figure 11:
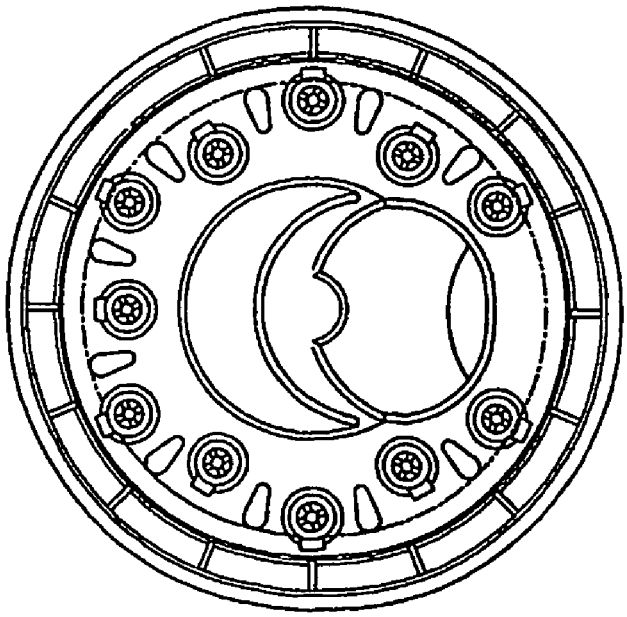
FIG. 11 is an end view of a fifth attachment for cooperation with the device of FIG. 1, in accordance with an alternative embodiment of the present invention.

Preferably, the one or more ion emitters 25 is/are situated outside housing 5. Also preferably, one or more ion emitters 25 can selectively minimize dilution of ions with the airflow. Still further, preferably the one or more ion emitters 25 is/are located in a casing 45 on housing 5. Casing 45 can be integral with housing 5, as illustrated in FIG. 1, or removable to allow easy access to the one or more ion emitters 25 for cleaning and/or replacement thereof, as illustrated in FIG. 1A. This can be important as dust and other air particles or contaminates tend to collect on ion emitters and can thereby interfere with the ionization process. Preferably, the casing configuration can also further reduce the degree to which the one or more ion emitters 25 is/are directly exposed to the airflow exiting air outlet 40, and thereby minimize the degree to which air born contaminants negatively affect the operation of the one or more ion emitters 25.

In addition, preferably the one or more ion emitters 25 can have any configuration sufficient to emit ions having selectively different polarities and intensities, as well as to conform to the configuration and operation of device 1. For example, one or more ion emitters 25 can be in the form of a conductive needle, an array of such needles, a conductive plate, or any other like structure. Also, one or more ion emitters 25 can be formed from any material sufficient to effectively emit ions and conform to the configuration and operation of device 1, such as for example, a conductive metal, a conductive polymer, or a carbon material. Further, the one or more ion emitters 25 can be made of a conductive semi-fluid, such as a silicon gel. Still further, one or more ion emitters 25 preferably creates a concentration of ions having either a negative polarity or a positive polarity, or some combination thereof. One or more ion emitters 25 can also preferably be arranged to create a predictable area of concentrated ions sufficient to encompass the area proximate the head of a user and to intensify the exposure of ions to the hair. If device 1 employs blower 30 for generating an airflow, preferably one or more ion emitters 25 is/are situated at a distance from the airflow.

Figure 13:
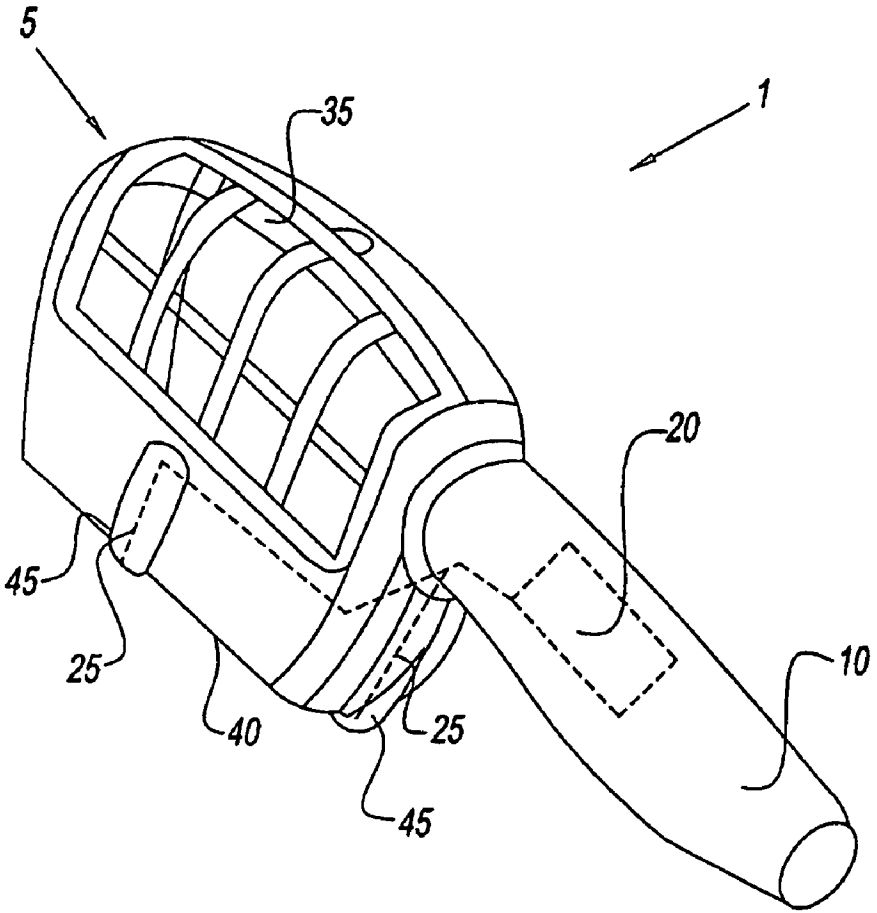
FIG. 13 is a perspective view of an alternative embodiment of the device of the present invention.
Figure 14:
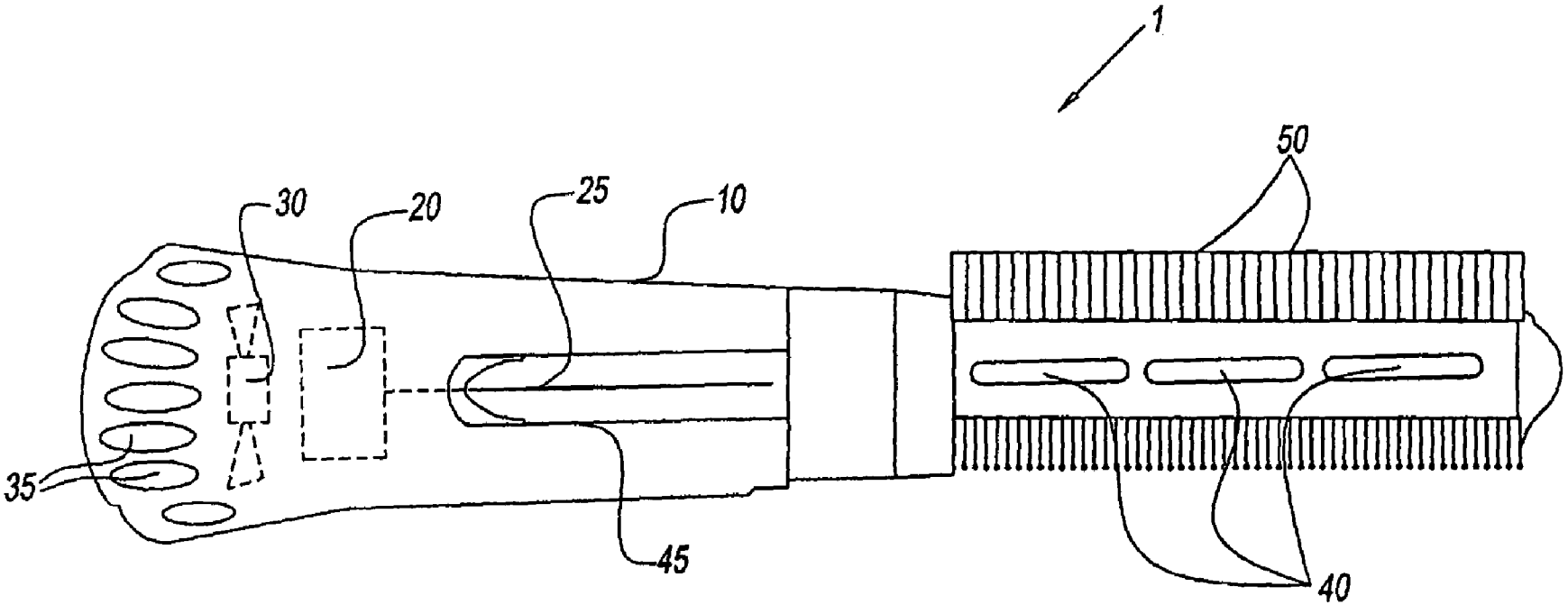
FIG. 14 is a lateral view of another alternative embodiment of the device of the present invention.
Figure 16:
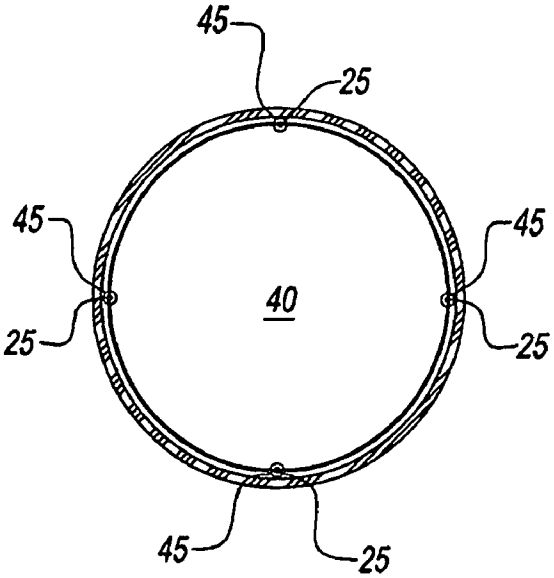
FIG. 16 is a plan view showing one possible arrangement of at least one ion emitter associated with the device of FIG. 15.
Figure 15:
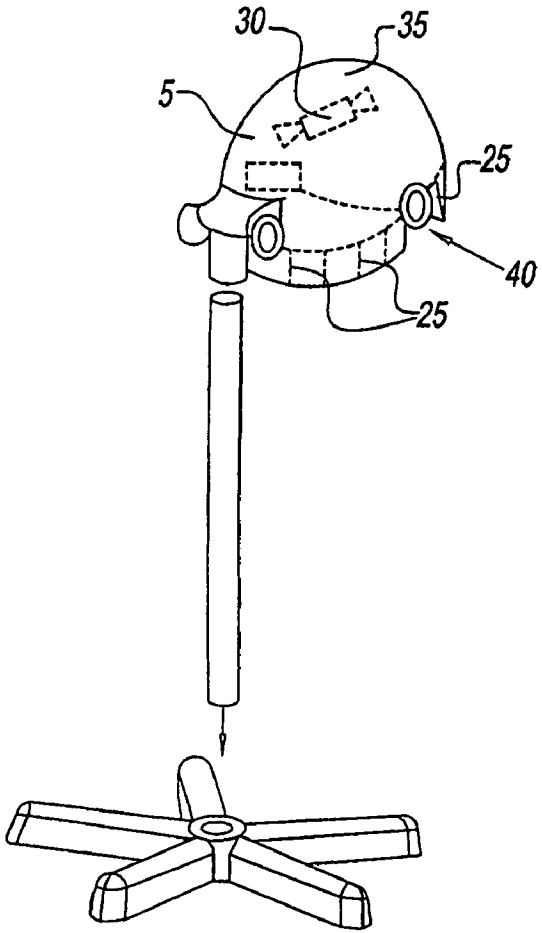
FIG. 15 is an exploded perspective view of still another alternative embodiment of the device of the present invention.
Figure 18:
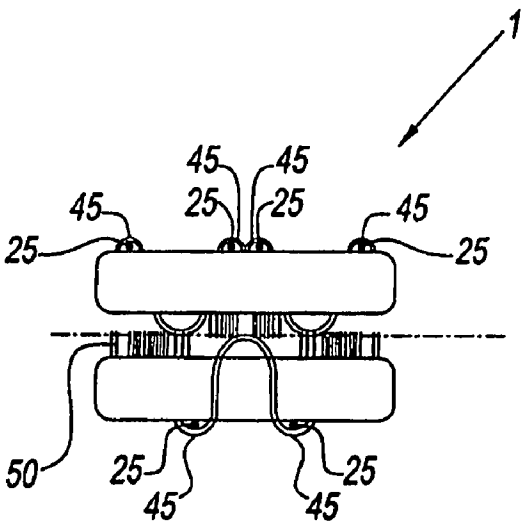
FIG. 18 is an end view of the alternative embodiment of the device of FIG. 17.
Figure 17:
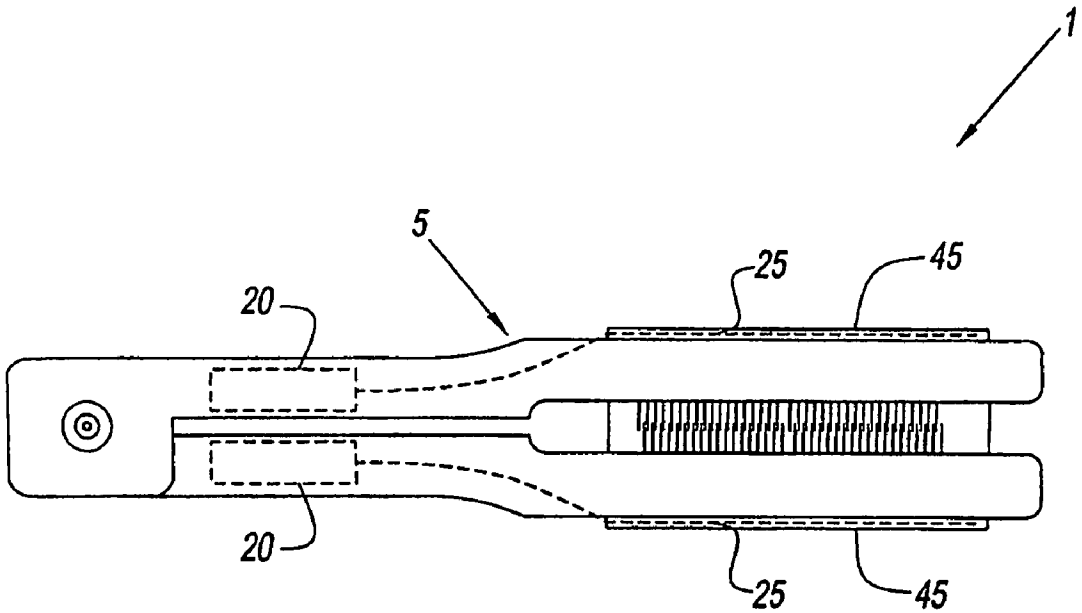
FIG. 17 is a lateral view of yet another alternative embodiment of the device of the present invention.
Figure 19:
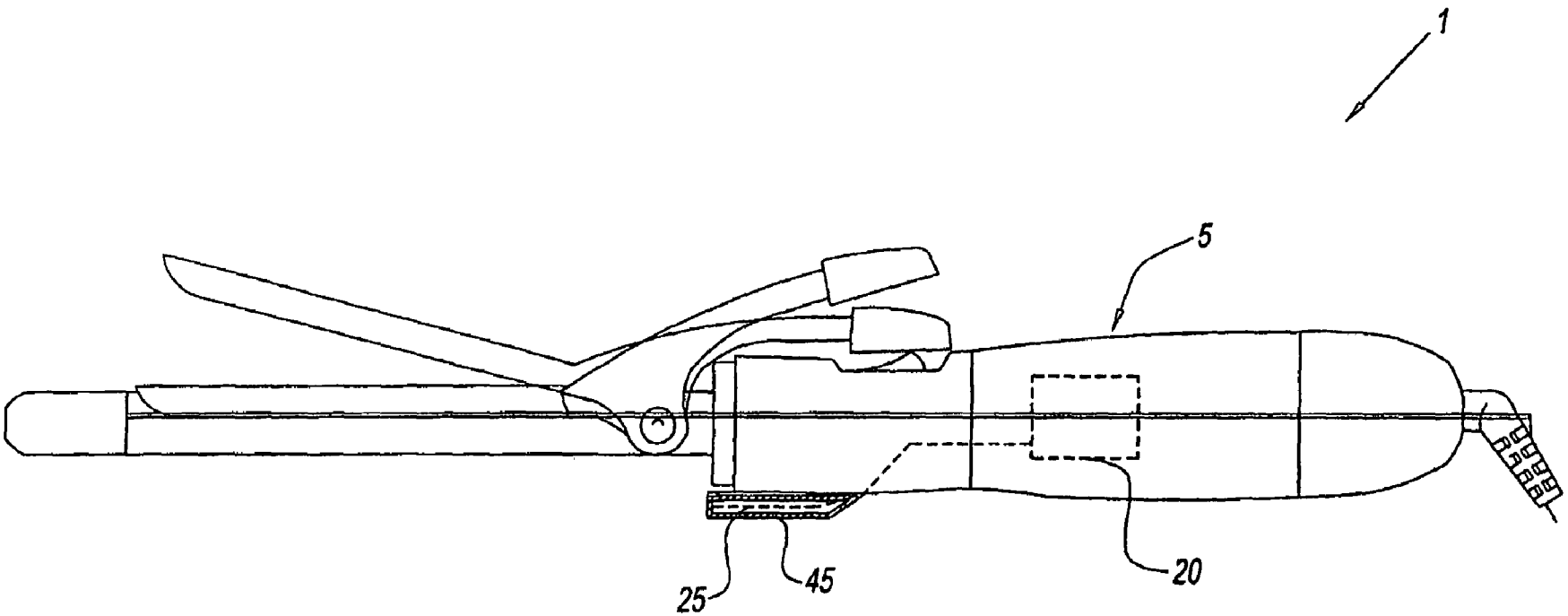
FIG. 19 is a perspective view of yet still another alternative embodiment of the device of the present invention.

Having described in detail the preferred embodiment of the present invention, it is appreciated that details may be modified in a variety of ways and that alternative embodiments are also within the scope of the present invention. Thus, device 1 can preferably be any device suitable for use with hair, such as for example, a hatchet hair dryer, as shown in FIG. 13, an air curling iron, as shown in FIG. 14, a hooded salon style hair dryer, as shown in FIGS. 15 and 16, a hair straightening iron or brush, as shown in FIGS. 17 and 18, or a conventional hair curling iron, as shown in FIG. 19.

The process of using device 1 comprises, regardless of the embodiment employed, adjustably creating various ion concentrations. Each concentration has a different polarity combination so that the ions are created at a distance from the head and/or hair of a user in order to optimize the known beneficial effects of ionization to the user. Further, if the embodiment of device 1 has a blower for generating an airflow, the process of using the device can preferably include adjustably creating the various concentrations of ions at a distance from the airflow generated by the blower in order to minimize any dilution resulting from direct exposure to the airflow and to maximize ionization of the air proximate the head and/or hair of the user. Still further, the process of using device 1 can preferably include employing a variety of attachments, see FIGS. 3 through 12, adapted for selective cooperation with the device for adjustably controlling the mix and distribution of the ion concentration.

The present invention having been thus described with particular reference to the preferred forms thereof, it will be obvious that various changes and modifications may be made therein without departing from the spirit of the present invention as defined herein.

What is claimed:

1. A method for treating hair comprising the steps of:

providing a device having a housing with at least one air outlet disposed therein, a blower for generating an airflow stream, one or more ion generators, and one or more ion emitters disposed outside, but adjacent to said housing and spaced a distance from said airflow exiting said air outlet;

applying said blower generated airflow toward hair for drying and/or styling;

generating an ion concentration having a certain area and spaced a certain distance from said airflow to minimize any dilution resulting from direct exposure to said airflow; and providing at least one attachment for cooperating with said air outlet of said housing for controlling the mixing of said ion concentration with said airflow stream and hair.

2. The method for treating hair of claim 1, wherein said at least one attachment is configured to variably control aspiration of said positive and negative ions into said airflow.

3. The method for treating hair of claim 2, wherein said at least one blower alters said airflow velocity, thereby controlling said aspiration of said positive and negative ions into said airflow.

4. The method for treating hair of claim 1, wherein said at least one ion generator is configured to provide a variety of voltage outputs, as well as to generate combinations of positive and negative ions.

5. The method for treating hair of claim 1, wherein said one or more ion emitters is/are positioned in a casing formed on said housing.

6. The method for treating hair of claim 1, wherein said plurality of ion emitters are formed from a conductive metal.

7. The method for treating hair of claim 1, wherein said one or more ion emitters is/are formed from a conductive polymer.

8. The method for treating hair of claim 1, wherein said one or more ion emitters is/are formed from a conductive silicon.

9. The method for treating hair of claim 1, wherein said one or more ion emitters form an array.

10. The method for treating hair of claim 1, wherein said one or more ion emitters create an ion concentration having a negative polarity.

11. The method for treating hair of claim 1, wherein said one or more ion emitters create an ion concentration having a positive polarity.

12. The method for treating hair of claim 1, wherein said one or more ion emitters create an ion concentration having both a positive and negative polarity.

13. The method for treating hair of claim 1, wherein said one or more ion emitters is/are arranged to generate a predictable area of concentrated ions and to minimize any dilution resulting from direct exposure to said airflow.

14. The method for treating hair of claim 1, wherein the device generates ions of positive polarity and ions of negative polarity, wherein said one or more ion emitters is a plurality of ion emitters for emitting ions of positive polarity and ions of negative polarity.

15. The method for treating hair of claim 14, wherein said ions form said ion concentration outside said housing and at a distance from a user's hair.

16. The method for treating hair of claim 15, wherein said hair is encompassed by said ion concentration.

17. The method for treating hair of claim 14, wherein said housing has at least one aperture disposed therein forming an air outlet for directing said airflow.

18. The method for treating hair of claim 17, wherein said least one attachment for cooperating with said air outlet manipulates said airflow exiting said air outlet.

19. The method for treating hair of claim 14, wherein said casing is selectively removable from said housing.

* * * * *